US008997664B2

(12) United States Patent
Broglio et al.

(10) Patent No.: US 8,997,664 B2
(45) **Date of Patent: *Apr. 7, 2015**

(54) GASIFICATION COMBUSTION SYSTEM

(71) Applicant: Covanta Energy Corporation, Fairfield, NJ (US)

(72) Inventors: Ron Broglio, Vandiver, AL (US); Hanwei Zhang, Princeton, NJ (US); Robert Barker, Hockessin, DE (US); Stephen Goff, Allentown, PA (US)

(73) Assignee: Covanta Energy, LLC, Morristown, NJ (US)

( * ) Notice: Subject to any disclaimer, the term of this patent is extended or adjusted under 35 U.S.C. 154(b) by 10 days.

This patent is subject to a terminal disclaimer.

(21) Appl. No.: 13/725,110

(22) Filed: Dec. 21, 2012

(65) Prior Publication Data

US 2013/0213283 A1 Aug. 22, 2013

Related U.S. Application Data

(63) Continuation-in-part of application No. 12/467,887, filed on May 18, 2009.

(51) Int. Cl.
*F23G 5/027* (2006.01)
*F23B 10/02* (2011.01)
(Continued)

(52) U.S. Cl.
CPC *F23G 5/027* (2013.01); *F23G 5/38* (2013.01); *F23G 5/50* (2013.01); *F23N 3/00* (2013.01); *F23N 5/02* (2013.01); *F23G 5/16* (2013.01); *F23G 2202/103* (2013.01); *F23G 2202/106* (2013.01); *F23G 2205/10* (2013.01); *F23G 2205/121* (2013.01); *F23G 2206/10* (2013.01);
(Continued)

(58) Field of Classification Search
CPC ..... F23B 5/04; F23B 10/02; F23B 90/06; F23G 5/027; F23G 5/0273; F23G 5/0276; F23G 2201/304; F23G 2202/103
USPC ..... 110/229, 230, 231, 225, 295, 296; 48/119, 120, 122, 123, 89, 101, 113
See application file for complete search history.

(56) References Cited

U.S. PATENT DOCUMENTS 2,283,641 A * 5/1942 Martin et al. ..... 110/225
2,491,435 A 12/1949 Yellott
(Continued)

FOREIGN PATENT DOCUMENTS

JP 2004077013 A 3/2004
JP 2006023030 A 1/2006
(Continued)

OTHER PUBLICATIONS

International Search Report, mailed Apr. 3, 2011, International Application No. PCT/US2010/035259.
(Continued)

*Primary Examiner* — Kenneth Rinehart
*Assistant Examiner* — David J Laux
(74) *Attorney, Agent, or Firm* — Hogan Lovells US LLP

(57) ABSTRACT

A two stage refuse gasification combustion system for processing refuse is disclosed. The system may contain features such as an advancer, a first and second gasifier, a gas regulator, and a post combustor. Additionally, methods for regulating gas and advancing refuse through a two stage refuse gasification combustion system are disclosed.

12 Claims, 7 Drawing Sheets

(51) Int. Cl.

| | |
|---|---|
| ***F23G 5/38*** | (2006.01) |
| ***F23G 5/50*** | (2006.01) |
| ***F23N 3/00*** | (2006.01) |
| ***F23N 5/02*** | (2006.01) |
| ***F23G 5/16*** | (2006.01) |

(52) U.S. Cl.
CPC ... *F23G 2207/20* (2013.01); *F23G 2900/00001* (2013.01); *F23G 2900/50001* (2013.01)

(56) References Cited

U.S. PATENT DOCUMENTS

| | | | | | |
|---|---|---|---|---|---|
| 2,884,368 | A | | 4/1959 | Sweeney | |
| 4,332,206 | A | | 6/1982 | Tucker et al. | |
| 4,417,528 | A | * | 11/1983 | Vining et al. | 110/229 |
| 4,432,290 | A | * | 2/1984 | Ishii et al. | 110/346 |
| 4,481,890 | A | * | 11/1984 | Lewis | 110/225 |
| 4,597,771 | A | | 7/1986 | Cheng | |
| 4,679,268 | A | * | 7/1987 | Gurries et al. | 110/346 |
| 4,715,810 | A | | 12/1987 | Ramsey et al. | |
| 4,765,256 | A | * | 8/1988 | Caughey | 110/229 |
| 4,784,603 | A | | 11/1988 | Robak, Jr. et al. | |
| 4,917,023 | A | * | 4/1990 | Jones | 110/230 |
| 5,005,493 | A | | 4/1991 | Gitman | |
| 5,027,751 | A | * | 7/1991 | Archer et al. | 122/449 |
| 5,505,145 | A | | 4/1996 | Gross et al. | |
| 6,067,916 | A | * | 5/2000 | Martin et al. | 110/348 |
| 6,148,599 | A | | 11/2000 | McIntosh et al. | |
| 6,199,492 | B1 | * | 3/2001 | Kunstler | 110/342 |
| 6,227,847 | B1 | * | 5/2001 | Gillespie | 432/72 |
| 6,250,236 | B1 | | 6/2001 | Feizollahi | |
| 6,485,296 | B1 | * | 11/2002 | Bender et al. | 432/58 |
| 7,878,131 | B2 | * | 2/2011 | Becchetti et al. | 110/230 |
| 7,947,095 | B2 | | 5/2011 | Patonen et al. | |
| 8,038,744 | B2 | | 10/2011 | Clark | |
| 8,038,746 | B2 | | 10/2011 | Clark | |
| 2007/0012230 | A1 | | 1/2007 | Hashimoto et al. | |
| 2009/0020456 | A1 | | 1/2009 | Tsangaris et al. | |
| 2010/0077942 | A1 | | 4/2010 | D'Agostini et al. | |
| 2012/0036777 | A1 | | 2/2012 | Patel | |

FOREIGN PATENT DOCUMENTS

| | | | |
|---|---|---|---|
| WO | 8102582 | A1 | 9/1981 |
| WO | 8103216 | A1 | 11/1981 |
| WO | 0221047 | A1 | 3/2002 |
| WO | 2008149145 | A2 | 12/2008 |
| WO | 2010067223 | A1 | 6/2010 |
| WO | 2010083519 | A1 | 7/2010 |

OTHER PUBLICATIONS

Ishikawajima-Harima Heavy Industries Co., Ltd., Japanese Article, "Predicition of Heat Transfer and Flow Characteristics in Waste Incinerators," ISSN: 0578,7904, vol. 44, No. 6, Nov. 2004, pp. 361-367.

* cited by examiner

GASIFICATION COMBUSTION SYSTEM

FIELD OF THE INVENTION

The present invention relates to gasification or combustion systems generally. More specifically, the present invention relates to methods and systems for regulating the flow of gas and refuse through a gasifier or combustor system.

BACKGROUND

Municipal solid waste ("MSW") is the gross product collected and processed by municipalities and governments. MSW includes durable and non-durable goods, containers and packaging, food and yard wastes, as well as miscellaneous inorganic wastes from residential, commercial, and industrial sources. Examples include newsprint, appliances, clothing, scrap food, containers and packaging, disposable diapers, plastics of all sort including disposable tableware and foamed packaging materials, rubber and wood products, potting soil, yard trimmings and consumer electronics, as part of an open-ended list of disposable or throw-away products. A traditional method of waste disposal is a landfill, which is still a common practice in some areas. Many local authorities, however, have found it difficult to establish new landfills. In those areas, the solid waste must be transported for disposal, making it more expensive.

As an alternative to landfills, a substantial amount of MSW may be disposed of by combustion at a municipal solid waste combustor ("MWC") to help recover energy from the waste. The conversion of waste to energy is often performed at a waste-to-energy plant ("WTE"). One of the problems associated with the conventional combustion of MSW and other solid fuels is that it creates small amounts of undesirable and potentially harmful byproducts, such as Nitrous Oxides (NOx), carbon monoxide, and dioxins. For example, NOx is formed during combustion through two primary mechanisms. First, fuel NOx is formed by the oxidation of organically bound nitrogen (N) found in MSW and other fuels. When the amount of O2 in the combustion chamber is low, N2 is the predominant reaction product. However, when a substantial amount of O2 is available, an increased portion of the fuel-bound N is converted to NOx. Second, thermal NOx is formed by the oxidation of atmospheric N2 at high temperatures. Because of the high activation energy required, thermal NOx formation does not become significant until flame temperatures reach 1,100° C. (2,000° F.).

Despite the improvements made in reducing the harmful emissions of conventional combustion systems, there is still a need for alternative methods and systems that efficiently convert MSW or other solid fuels to energy while producing a minimal amount of undesirable emissions.

SUMMARY OF THE INVENTION

The present invention relates to a gasification combustion systems and methods that control the rate of gasification or combustion. By controlling the oxidant supply and temperature of gasification or combustion, the system can more efficiently burn refuse and reduce the emission of harmful products (gases and/or solids) into the atmosphere. Additionally, by controlling the rate and temperature of gasification or combustion, a more durable system can be created which will be more efficient in terms of energy conversion and flue gas processing after MSW thermal treatment.

Embodiments of the present invention may employ a moving grate that enables the movement of waste through the combustion chamber and thus allows complete combustion of the waste. Additionally, a primary air source and a secondary air source may be utilized. Primary air may be supplied from under the grate and forced through the grate to sequentially dry (evolve water), de-volatilize (evolve volatile hydrocarbons), and burn out (oxidize nonvolatile hydrocarbons) along the waste bed. The quantity of primary air may be adjusted to maximize burn out of the carbonaceous materials in the waste bed, while minimizing the excess air. Secondary air may be supplied through nozzles located above the grate and used to create turbulent mixing that destroys the hydrocarbons that evolved from the waste bed. The total amount of air (primary and secondary) used in the system may vary from approximately 30% to 100% more than the amount of air required to achieve stoichiometric conditions (i.e., the minimum amount of air to theoretically completely combust the fuel).

The invention may utilize different technologies for reducing the harmful emissions created by conventional MSW combustion systems. For example, combustion controls and post-combustion controls may be used. Combustion controls limit the formation of NOx during the combustion process by reducing the availability of $O_2$ within the flame and by lowering combustion zone temperatures; whereas post-combustion controls involve the removal of the NOx emissions produced during the combustion process (e.g., selective non-catalytic reduction (SNCR) systems and selective catalytic reduction (SCR) systems).

In one embodiment of the present invention, a two stage refuse gasification combustion system for processing refuse is disclosed. The system may include an advancer, a first and second gasifier, a first gas regulator, and a post combustor. The post combustor may contain a connection to the first and second gasifier, and an ash collector designed to receive fly ash and heavy weight particles. The ash collector may contain a connection to the second gasifier for directing the fly ash and heavy weight particles into the second gasifier. The first gas regulator may contain an input port for receiving gas, an output port for outputting gas, valves for regulating gas flow, and control software to allow the regulator to control opening and closing of the valves which regulate how much gas flows into the input port and how much gas flows out of the output port.

In one embodiment of the invention, the system may include an advancer and two gasifier chambers. The gasifiers may be connected by, for example, a drop chute whereby the residue from the one gasifier flows into the other gasifier. In one example, the second gasifier may complete the combustion of unreacted carbon in the residue passing from the first gasifier to the second gasifier. The second gasifier may be fed with an additional gas source. For example, the second gasifier may be fed with fresh primary air in an amount that is in excess of the amount needed to complete the combustion of the carbon content of the material entering the second gasifier chamber. The fresh primary air distribution to the second gasifier chamber may be controlled to achieve a high burnout efficiency of the carbon, leaving a low residual carbon content in the ash exiting the second gasifier.

In one embodiment, the hot combustion flue gas from the second gasifier chamber may be mixed with an additional gas source. For example, hot combustion flue gas from the second gasifier chamber may be mixed with additional fresh air to control the temperature of the gas. Further, the hot combustion flue gas may be passed through a particulate removal device to remove entrained particulate. The hot combustion gas may be used to provide both primary and secondary air to the first gasifier chamber. In addition to controlling the temperature by mixing the hot combustion gas with additional gas sources, the flow rate of the gases may also be controlled. For example, the gas flow rate of the hot combustion gas may be adjusted to control the temperature in the first gasifier chamber to efficiently promote the drying and gasification of the incoming waste. The desired temperature will vary depending on the heating value of the waste feed, but, as an example, may range between around 1600 and around 1800° F. The elevated temperature of the hot combustion flue gas from the second gasifier, caused by the energy release from combusting the residual carbon content in the residue entering the second gasifier chamber, advantageously increases the rate of drying and gasification of the waste in the first gasifier chamber. This reduces the fraction of organic content in the waste that must be oxidized in the first gasifier chamber and, in turn, reduces the volume of sub-stoichiometric flow of oxygen-containing air to the first gasifier chamber that may be required. Controlling the gas parameters as described herein (including temperature, composition, mixing, and flow rates) has many advantages including more efficient energy integration. This energy integration has significant improvements over the prior art, including increasing the heating value of the syngas produced from the first gasifier chamber as measured by, for example, its hydrogen and carbon monoxide contents. This represents a significant improvement in efficiency over the prior art.

In one embodiment, the syngas exiting the first gasifier chamber may be sent to a syngas combustor where it may be combusted. Additional gas may be included in this combustion. For example, hot combustion gas may be fed to the syngas combustion chamber. As above, a particulate removal device may be sued. Some amount of fresh air may also be included if, for example, necessary to complete the combustion of the syngas. Other gases may also be added to the combustion. The distribution, flowrate, etc. of any gases in the syngas combustor, including the syngas, may be controlled. This control has many advantages, including achieving low levels of both $NO_x$ and CO in the flue gas exiting the syngas combustor.

In general, reactions in the first chamber (such as gasification reactions) may be controlled separately from reactions in the second chamber (such as combustion reactions), and the energy released by the reactions in the second chamber may be efficiently recovered and utilized to promote the reactions in the first chamber. The process integration, described above and herein, enables the required air flow to the first chamber to be minimized, which, among other advantages, increases the heating value of the syngas produced from the first chamber.

In an embodiment of the present invention, a two stage refuse gasification combustion system for processing refuse is disclosed. The system may include an advancer, one or more gasifiers, a first gas regulator, and a post combustor. The post combustor may contain a connection to the one or more gasifier whereby residue from the one or more gasifiers flows into the post combustor. The residue may comprise gas residue, non-gas residue including organic content that was not oxidized in the one or more gasifiers, or a combination of gas and non-gas residue. The system may further include an ash collector designed to receive fly ash and heavy weight particles. The ash collector may contain a connection to the one or more gasifiers for directing the fly ash and heavy weight particles into the gasifiers. In the alternative, the ash collector may be connected to the post combustor. The post combustor and the one or more gasifiers may be connected by, for example, a drop chute whereby the residue from the one or more gasifiers flows into the post combustor. The first gas regulator may contain an input port for receiving gas, an output port for outputting gas, valves for regulating gas flow, and control software to allow the regulator to control opening and closing of the valves which regulate how much gas flows into the input port and how much gas flows out of the output port.

In one embodiment of the systems and methods described herein, the post combustor may comprise a burnout chamber wherein residue from a gasifier is oxidized with excess oxygen. For example, the amount of oxygen supplied may be over the stoichiometric requirement for complete combustion of the remaining organic content in the post combustor. As a further example, the concentration of oxygen may be between around 4 and around 10% $O_2$ as measured in the vapor space above the grate in the post combustor. In one embodiment, the temperature of the excess oxygen may be ambient temperature. The excess oxygen may be supplied as air.

Reactions in the separate chambers may be controlled separately from reactions in the other chamber. For example, the energy released by the combustion in one chamber may be efficiently recovered and utilized to promote the reactions (such as gasification) in another chamber. This process integration enables the required air flow to the gasification chamber to be minimized, increasing the heating value of the syngas produced.

In an embodiment of the present invention, a two stage refuse gasification combustion system for processing refuse is disclosed. The system may comprise an advancer, one or more gasifiers, a first gas regulator, and one or more post combustors. One post combustor may contain a connection to one or more of the gasifiers whereby certain gas residues from the gasifier flows into the post combustor. For example, the gas residue may be syngas or a similar gas, or a combination of syngas and other gases, for combustion. A second post combustor may also be connected to one or more of the gasifiers. The second post combustor may also collect residue from one or more of the gasifiers. The residue in the second post combustor may comprise gas residue, non-gas residue including organic content that was not oxidized in the gasifier, or a combination of gas and non-gas residue. In one embodiment, the second post combustor may comprise a burnout chamber wherein residue from one or more of the gasifiers is oxidized with excess oxygen. For example, the amount of oxygen supplied may be over the stoichiometric requirement for complete combustion of the remaining organic content in the second post combustor. As a further example, the concentration of oxygen may be between around 4% and around 10% $O_2$ as measured in the vapor space above the grate in the post combustor. In one embodiment, the temperature of the excess oxygen may be ambient temperature. The excess oxygen may be supplied as air, such as ambient air.

The systems may further include an ash collector designed to receive fly ash and heavy weight particles. The ash collector may contain a connection to the gasifier for directing the fly ash and heavy weight particles into the gasifier. In the alternative, the ash collector may be connected to the post combustor. The post combustor and the gasifier may be connected by, for example, a drop chute whereby the residue from the gasifier flows into the post combustor. The first gas regulator may contain an input port for receiving gas, an output port for outputting gas, valves for regulating gas flow, and control software to allow the regulator to control opening and closing of the valves which regulate how much gas flows into the input port and how much gas flows out of the output port.

Reactions in the separate chambers may be controlled separately from reactions in the other chamber. For example, the energy released by the combustion in one chamber may be efficiently recovered and utilized to promote the reactions (such as gasification) in another chamber. This process integration enables the required air flow to the gasification chamber to be minimized, increasing the heating value of the syngas produced.

The systems and methods described herein may also contain the following additional features. The system may comprise an input having an opening formed by an outer housing for receiving said refuse. The system may comprise a first gas hopper fluidly connected to a first gas splitter and the first gasifier. The first gas splitter may be connectable to a gas source for receiving gas external from the system. Also the first and second gasifier may comprise a sloped top for directing gas into the post combustor. The system may comprise a second gas hopper fluidly connected to a second gas splitter and the second gasifier. The second gas splitter may be connectable to a gas source for receiving gas external from the system. The ash collector of the post combustor may comprise a conical or cyclone shape. The first regulator may comprise: a gas source containing compressed gas or a gas movement device; a sensor for determining gas temperature in the post combustor or ports leading into the post combustor; and an adjuster for adjusting the amount of gas flowing into the post combustor. The adjuster may also allow the regulator to adjust the angle in which ports expel gas into the post combustor. The system may also comprise a flue connected to the post combustor. The flue may comprise a valve operable to allow gas to escape the system when the valve is in a first position or cause gas to recirculate in a second position. The system may also comprise a second gas regulator for directing gas through the system. The second gas regulator may contain a connection with the flue to receive recirculated gas from the flue and a valve controller to control the position of the flue valve. For example, a gas regulator, such as the second gas regulator, may redirect hot gas from the post combustor to a gasifier. This hot gas may be used as primary air in a gasifier, either as the sole source of primary air or mixed with additional gas sources. The second gas regulator may also comprise a connection to the gas source to allow the second gas regulator to receive gas external from the system; a gas output connected to the first gas regulator to direct gas into the first gas regulator; and a valve and valve controller to control how much gas from the flue and the gas source flows through the gas output. The first gas regulator may comprise an input for receiving gas from the second gasifier and an input for receiving gas from the second gas regulator, and at least three output ports for directing gas into the post combustor. The first output port may be connected to a lower portion of a sidewall of the post combustor for directing gas horizontally in the post combustor. The second output port may be connected to an upper portion of the sidewall of the post combustor for directing gas horizontally in the post combustor. The third output port may be connected to a top portion of the post combustor for directing gas downwardly into the post combustor. The first gas regulator may contain an adjuster for manipulating the angle at which the three output ports direct gas into the post combustor.

The system can comprise a central controller which may contain software stored on computer readable media (such as RAM or optical media), and a microprocessor for allowing the controller to regulate the flow of oxygen containing streams throughout the system. For example, the software may cause the controller to increase the speed of the advancer; controlling the flow rate of gas through a first and second gas splitter; and controlling the positioning of the valves in the first gas regulator. The software may also allow the controller to control various functions of certain system components such as gas splitters, flue gas splitter, the first and second gas regulators, gasifiers, and the advancer. In some embodiments these components may also comprise microprocessors, memory, and their own instruction sets as well. The software of the controller (or the regulators or both) may contain one or more set of instructions for regulating and controlling the amount of oxygen in the ports entering the various components of the system (such as the first gasifier, the second gasifier, and the post combustor) thereby controlling the temperature and speed of the gasification and combustion of the refuse and gases, allowing the system to reduce the production $NO_x$ or other undesirable byproducts, while also completing the gasification and combustion of the organic content of the refuse before it enters the bottom ash collector. For example, a first instruction of this instruction set may cause the controller to instruct gas splitter to send gas having a low oxygen content (such as around 5%-20% $O_2$ by weight, preferably around 5%-10%) to the first gasifier through gas splitter. To do this, controller (or gas splitter) may instruct regulator to send recirculated gas through port. To obtain the recirculated gas, the regulator (or controller) may cause the valve in the flue to partially open allowing flue gas to enter port. A second instruction of this instruction set may cause the controller to instruct gas splitter to send oxygen rich gas (such as around 20-100% $O_2$ by weight) to the second gasifier through the second gas splitter. To do this, controller (or gas splitter) may instruct gas source to direct gas into gas splitter (or gas splitter may open a valve allowing gas from gas source to enter gas splitter for example). Controller (or gas splitter) may also shut a valve connected to port to prevent the flow of recirculated gas from regulator (or the regulator may shut an appropriate valve in the flue for example.) A third instruction of this instruction set may cause the controller to instruct regulator to monitor the temperature of the gases in the post combustor (regulator may also monitor the oxygen content of the gases in the post combustor. Alternatively, controller may be equipped with a sensor and may perform the monitoring directly.) If the temperature of the gases in the post combustor becomes higher than a predetermined value (such as around 1000° C.) (or the oxygen content of the post combustor gases becomes higher than a predetermined value, such as around 10% by volume regulator may request regulator to send recirculated (low oxygen content) gas to the post combustor. If the temperature becomes lower than a predetermined value (such as around 800° C.) (or the oxygen content of the post combustor gases becomes lower than a predetermined value, such as around 1% by volume, controller may request oxygen rich gas from a gas source be routed through the port through the regulators into the post combustor. (Alternatively if the regulators comprise their own gas source, the regulator may use this gas source to provide the oxygen rich gas.) Additionally, the controller may also monitor the temperature or oxygen content of the gas in various locations of the post combustor. If a certain section of the post combustor has gas at too high or too low of a temperature (or too high or too low of a percentage of oxygen), regulator may direct gas through a particular port to adjust the temperature (or oxygen content) of gas in that section of the post combustor. In some embodiments, regulator may also be able to adjust the angle at which the ports make with the post combustor to increase the regulator's ability to control the temperature (or oxygen content) of gases in the post combustor. Also, the central controller may be able to control the rate of advancement of the refuse through the refuse advancer.

In addition to above embodiments and their variants, methods for regulating gas and refuse through a two stage refuse gasification combustion system are disclosed. In one embodiment, the method may comprise the steps of: advancing the refuse into a first gasifier; processing the refuse at the first gasifier to generate volatiles in the first gasifier by directing the gas through the refuse; directing the gas and volatiles into a post combustor; combusting the gas and volatiles mixture in the post combustor; advancing the refuse into a second gasifier; processing the refuse in the second gasifier; directing gas from the second gasifier to a first gas regulator; and receiving gas from the first gas regulator and combusting the gas thereby producing heat and combustor gas.

In one embodiment, the method may include the steps, in any order, of: advancing the refuse into a first gasifier; processing the refuse at the first gasifier to generate volatiles in the first gasifier by directing the gas through the refuse; directing the gas and volatiles into a post combustor; combusting the gas and volatiles mixture in the post combustor; advancing the reside (including unreacted carbon content) from the first gasifier into a second gasifier; processing the residue in the second gasifier with an excess of air to complete the combustion of the carbon content; directing gas from the second gasifier to a gas regulator that directs and controls the gas (including adding additional gases, if necessary); the gas from the second gasifier being used, in part, to heat the first gasifier; and combusting some of the gas from the second gasifier. Of course, the method may include more or less steps that recited above.

The above methods may comprise additional steps or some of the steps may have additional features. For example, the above methods may comprise the step of receiving refuse at an input; advancing the refuse from the input to the first gasifier using an advancer; receiving gas at a first gas splitter; directing the gas from the first gas splitter through a first gas hopper to the first gasifier; receiving gas at a second gas splitter; and directing the gas from the second gas splitter through a second gas hopper to the second gasifier. The methods may also comprise the step of collecting residual fly ash and particles with an ash collector and directing the residual fly ash and particles into the second gasifier. Also, the step of processing the refuse at the second gasifier may transform the refuse into bottom ash, heat, and gas. The methods may incorporate advancing the bottom ash along the advancer into a bottom ash collector and directing the heat and gas into a first gas regulator. Further, the methods may include passing one or more gas streams through a particulate removal device. In an additional configuration, the method may require the steps of receiving gas at a first gas regulator from the second gasifier; receiving gas at the first gas regulator from a second gas regulator; and controlling the receipt of gas from the second gasifier and second gas regulator by adjusting one more internal valves. Also, the methods may entail: directing the combustor gas into a flue; controlling a valve controller to direct a valve to allow the combustor gas to escape the system or recirculate the gas back into the system; receiving gas from the flue and gas from the gas source at a second gas regulator; manipulating a valve to control how much gas from the flue and from the gas source flow through an output port; or directing gas into the first gas regulator by opening a valve in the output port of the second gas regulator.

DETAILED DESCRIPTION

Figure 1:
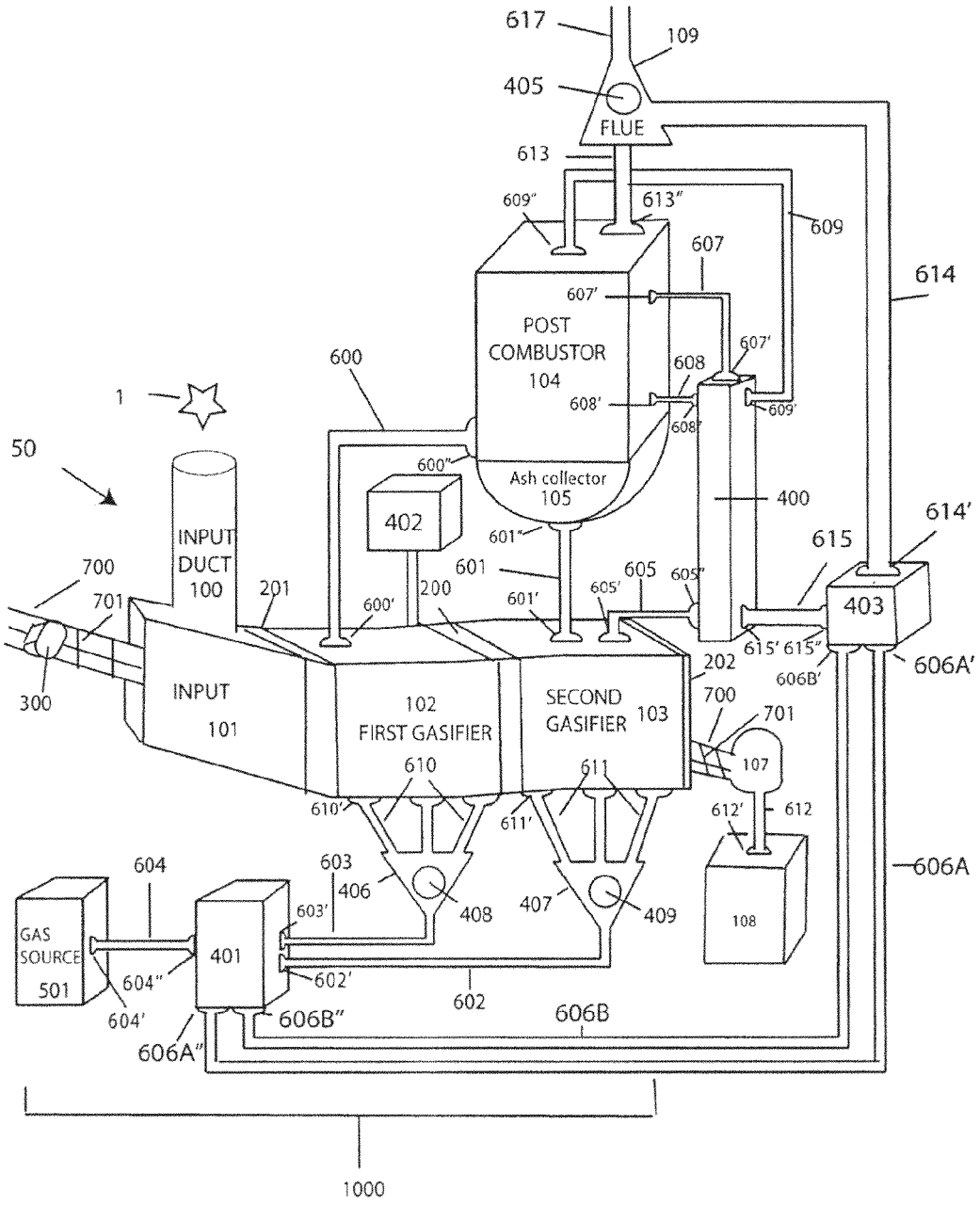
FIG. 1 is a forward view of an embodiment of the present invention wherein the gasifiers contain door ports.

FIG. 1 illustrates an embodiment of the present invention. The combustion gasification system (broadly denoted as element 50) comprises an input 101 for receiving refuse 1, a first gasifier 102, a second gasifier 103, and a post combustor 104. Refuse 1, trash, or waste may be placed into the input 101 through an input duct 100 containing an outer housing. The input 101 may comprise an opening formed by an outer housing for receiving the refuse. Processing of the refuse 1 typically begins in the first gasifier 102. Processing may include one or more of the following functions: drying, devolatilizing, gasification, or combustion. In some embodiments oil or other flammable substances may be added to the refuse 1 to facilitate combustion.

Once inside the input 100, the refuse 1 may be advanced through the system 50 by a refuse advancer 700. The refuse advancer 700 may take form of a hydraulic ram 300 and grate 701 as shown in FIG. 1, or a self advancing advancer may be used. In other embodiments the advancer 700 can take the form of a cork screw advancer or a stoker for example. Additionally, gravity or magnetism for example may be used to advance the refuse 1. The refuse advancer 700 may extend through the first gasifier 102, the second gasifier 103, and into the bottom ash collector 107. The refuse advancer 700 may be positioned in a downward angle to facilitate the movement of the refuse forward through the first 102 and second gasifiers 103 where the refuse will be processed. In preferred embodiments, the refuse 1 will be completely or nearly completely processed by the time the refuse 1 reaches the bottom ash collector 107.

There are a number of ports, pipes, or ducts extending to and from the gasifiers. These ports (600-615) transport various gases and particles throughout the system 50. In some embodiments connectors (600'-615' and 600"-615") may be used to connect the ports 600-615 to various components of the system (such as the first gasifier 102 or the post combustor 104).

The first gasifier 102 has a first gasifier gas port 600 and gas connector 600' and gas hoppers 610 and gas hopper connectors 610'. In some embodiments, each gasifier may contain as little as 1 gas hopper or as many as 10 or more gas hoppers with 3 or 4 gas hoppers being preferred. The gas port 600 is designed to receive volatile gases which are released when the refuse 1 is gasified. Molecules such as diatomic nitrogen, methane, diatomic hydrogen, carbon dioxide, carbon monoxide, water vapor, various other metallic and non metallic compounds may be released depending on the composition of the refuse 1. The gas in port 600 is commonly called synthetic gas "syngas", since it is a gas comprising carbon monoxide and hydrogen which is produced during the gasification of the refuse.

The gas hoppers 610 provide gas from the gas source 501 to the first gasifier 102 to control the gasification or burn rate of the refuse 1. In some embodiments this gas may take the form of atmospheric air, but other gas such as $O_2$, $CO_2$, and water vapor may be used alone or in combination with each other or other gases. The valves 408 and 409 can regulate how much gas goes into each hopper 610 and 611. Gas splitters 406 and 407 receive the gas from gas ports 603 and 602. Regulator 401, in some embodiments, can regulate the temperature, composition, and humidity of the gas. Additionally gas splitter 401 may regulate the flow rate of the gas through the gas ports 602 and 603. Gas source 501 may contain pressurized gas or may be a gas delivery machine such as fan for example. Gas source 501 may receive the gas from an unshown supply, or may circulate atmospheric gas into the gas port 604. One or more of the regulators (403 & 400) may contain an air input which allows the regulators to insert gas from a gas supply or atmospheric gas to be entered into the system 50. The entire gas source assembly is broadly denoted as element 1000.

Figure 3:
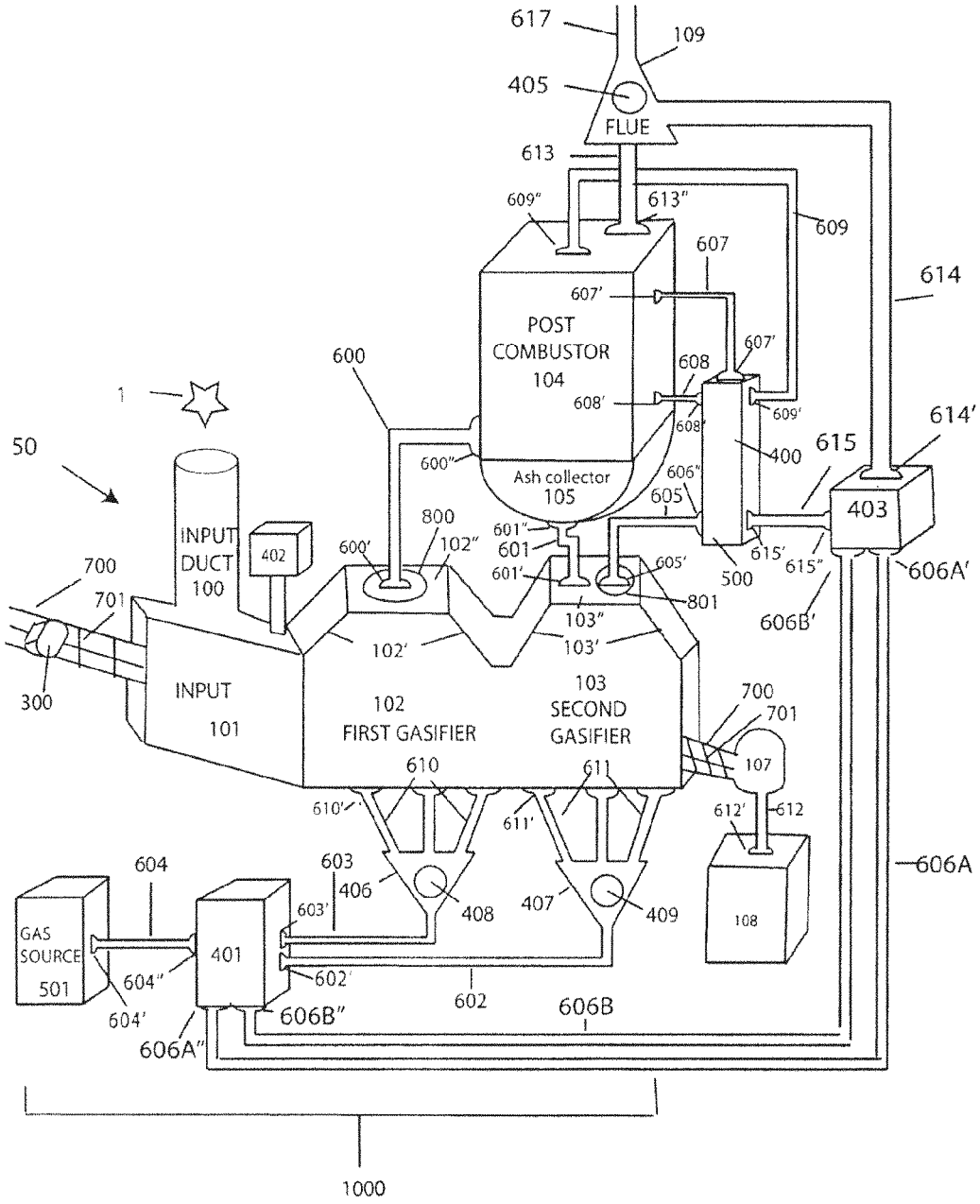
FIG. 3 is a forward view of an embodiment of the present invention wherein the gasifiers contain venting hood fans and no door ports.

In the embodiment of FIG. 1, when the refuse reaches the end of the first gasifier 102, the first gasifier door port 200 will open, allowing the refuse to exit the first gasifier 102 and enter the second gasifier 103. As shown, the second gasifier also is connected to a series of gas hoppers 611 and gas hopper connectors 611'. Additionally the second gasifier is connected to an ash port 601 and second gasifier gas port 605. Ash from the post combustor 104 may enter the second gasifier through the ash port 601 which contains connectors 601" and 601'. Oxygen-containing gas may leave the second gasifier through the second gasifier gas port 605 which may be attached to the second gasifier 103 via gas port 605'. After a period of time, the refuse 1 will exit the gasifier through the second gasifier door port 202 where the refuse will be transported to the bottom ash collector 107. FIG. 3 shows an alternative embodiment of the system 50, wherein the gasifiers do not contain door ports 200 and 202. In order to help direct the gas upward into the post combustor, the gasifiers may utilize sloped top portions 102' and 103' which may function in conjunction with optional venting hood fans 800 and 801. (The first and second gasifier may also comprise faces such as a sidewall, frontwall, backwall, and a bottom portion.) The top of the gasifiers may be partially sloped so that a top portion 102" and 103" is formed, or the sloped top portions 102' and 103' may connect directly (not shown). The venting hood fans 800 and 801 may suck gas from the gasifiers 102 and 103 and direct the gas into ports 600 and 605. Although not shown in FIG. 1, the embodiment shown in FIG. 1 may be optionally constructed with venting hood fans to assist in transferring the gas from the gasifiers into the post combustor 104.

Returning to FIG. 1, the bottom ash collector 107 is responsible for collecting any materials which are still on the advancer 700. These materials may include any materials which did not gasify or combust in the first and second gasifiers. The bottom ash collector 107 may contain a repository 108 which stores the collected materials. In some embodiments the repository 108 may be integral with the bottom ash collector 107 or in other embodiments as shown, the repository 108 may be a separate part connected by way of an ash collector port 612 and connector 612'.

The post combustor 104 may receive volatiles and syngas from the first gasifier 102 through the first gasifier port 600. The post combustor 104 may mix these volatiles with oxygen-containing gas from the upper port 609 and side ports 607 and 608. The gas entering the post combustor 104 from the first gasifier 102 may be at a very high temperature which may increase the formation of nitrous oxide "NOx" when combusted. By controlling mixing of various gases in the post combustor, the first gas regulator 400 can lower the temperature of the combustion thereby creating less NOx. Lowering the production of NOx is desirable since NOx is highly toxic and can potentially damage human health. Gas regulator 400 can regulate how much gas flows into ports 608, 609, and 607 and how much gas flows from ports 605 and 615, by controlling various internal valves. Structurally, the post combustor 104 may comprise a substantially rectangular shape such as a rectangular prism or may comprise a more cylindrical shape. The post combustor may comprise six or more faces: such as a sidewall, a frontwall, a backwall, a bottom portion and a top portion. One or more output ports of the first gas regulator may attach to one of these faces. In the embodiment shown in FIG. 3, output port 608 attaches to a lower portion of the sidewall of the combustor 104, output port 607 attaches to an upper portion of the sidewall of the combustor 104, and output port 609 attaches to a top portion of the post combustor 104.

Gas regulators 400 and 403 may comprise a microprocessor and control software which enables the regulators to control the opening and closing of internal valves. In some embodiments, the regulator may be able to partially open and close the valves. Gas regulators 400 and 403 may comprise a gas source similar to gas source 501, which may include compressed gas or a gas movement device such as a fan. This gas source may be a source of air, water vapor, $O_2$, $CO_2$, $N_2$, and other gases. Regulators 400 and 403 may have a sensor which can determine the temperature of gas in the post combustor 104, ports 605, 615, and 600. Regulator 400 may contain an adjuster for adjusting the amount of gas flowing into the post combustor 104, and may be able to adjust the angle in which ports expel gas into the post combustor. For example, any of the ports may be equipped with an adjustable nozzle which can affect the direction of the gas flow.

Central controller 402 may contain software stored on computer readable media (such as RAM or optical media), and a microprocessor for allowing the controller to regulate the flow of oxygen containing streams throughout the system. The software may allow the controller 402 to control various functions of certain system components such as gas splitters 401, 406 and 407, flue gas splitter 405, the first and second gas regulators 400 and 403, gasifiers 102 and 103, and the advancer 700. In some embodiments these components may also comprise microprocessors, memory, and their own instruction sets as well. The software of the controller (or the regulators or both) may contain one or more set of instructions for regulating and controlling the amount of oxygen in the ports entering the various components of the system (such as the first gasifier 102, the second gasifier 103, and the post combustor 104) thereby controlling the temperature and speed of the gasification and combustion of the refuse and gases, allowing the system to reduce the production $NO_x$ or other undesirable byproducts, while also completing the gasification and combustion of the organic content of the refuse before it enters the bottom ash collector 107. For example, a first instruction of this instruction set may cause the controller 402 to instruct gas splitter 401 to send gas having a low oxygen content (such as around 5%-20% $O_2$ by weight, preferably around 5%-10%) to the first gasifier through gas splitter 406. To do this, controller 402 (or gas splitter 401) may instruct regulator 403 to send recirculated gas through port 606A. To obtain the recirculated gas, the regulator 403 (or controller 402) may cause the valve 405 in the flue 109 to partially open allowing flue gas to enter port 614. A second instruction of this instruction set may cause the controller 402 to instruct gas splitter 401 to send oxygen rich gas (such as around 20-100% $O_2$ by weight) to the second gasifier 103 through the second gas splitter 407. To do this, controller 402

(or gas splitter 401) may instruct gas source 501 to direct gas into gas splitter 401 (or gas splitter 401 may open a valve allowing gas from gas source 501 to enter gas splitter 401 for example). Controller 402 (or gas splitter 401) may also shut a valve connected to port 606A to prevent the flow of recirculated gas from regulator 403 (or regulator 403 may shut an appropriate valve in the flue 109 for example.) A third instruction of this instruction set may cause the controller 402 to instruct regulator 400 to monitor the temperature of the gases in the post combustor 104 (regulator 400 may also monitor the oxygen content of the gases in the post combustor 104. Alternatively, controller 402 may be equipped with a sensor and may perform the monitoring directly.) If the temperature of the gases in the post combustor 104 becomes higher than a predetermined value (such as around 1000° C.) (or the oxygen content of the post combustor gases becomes higher than a predetermined value, such as around 10% by volume, regulator 400 may request regulator 403 to send recirculated (low oxygen content) gas to the post combustor 104. If the temperature becomes lower than a predetermined value (such as around 800° C.) (or the oxygen content of the post combustor gases becomes lower than a predetermined value, such as around 1% by volume, controller 402 may request oxygen rich gas from gas source 501 be routed through the port 606A through the regulators 403 and 400 into the post combustor. (Alternatively if regulators 400 or 403 comprise their own gas source, the regulator may use this gas source to provide the oxygen rich gas.) Additionally, controller 402 may also monitor the temperature or oxygen content of the gas in various locations of the post combustor 104. If a certain section of the post combustor 104 has gas at too high or too low of a temperature (or too high or too low of a percentage of oxygen), regulator 400 may direct gas through a particular port 607, 608, or 609 to adjust the temperature (or oxygen content) of gas in that section of the post combustor. In some embodiments, regulator 400 may also be able to adjust the angle at which ports 607, 608, and 609 make with the post combustor 104 to increase the regulator's ability to control the temperature (or oxygen content) of gases in the post combustor. Also, the central controller 402 may be able to control the rate of advancement of the refuse 1 through the refuse advancer 700.

In some embodiments, an ash collector 105 may be attached to the bottom of the post combustor 104. The ash collector 105 may be used to collect fly ash or heavy weight particles that are created during gasification or combustion. The ash collector 105 may be aided by the downward flow of air from the top gas port 609. The downward air flow may cause the fly ash or other heavy weight particles downward through the post combustor 104 into the ash collector 105. The ash collector 105 may be cone shaped or cyclone shaped. The ash collector may be designed to collect the fly ash and other particles in the center of collector 105 and flow downward, or form slag on the walls of the collector 105 and flow downward. Ash collector 105 may be connected to the second gasifier 103 through second gasifier port 601 and may have connectors 601" and 601'.

Figure 4:
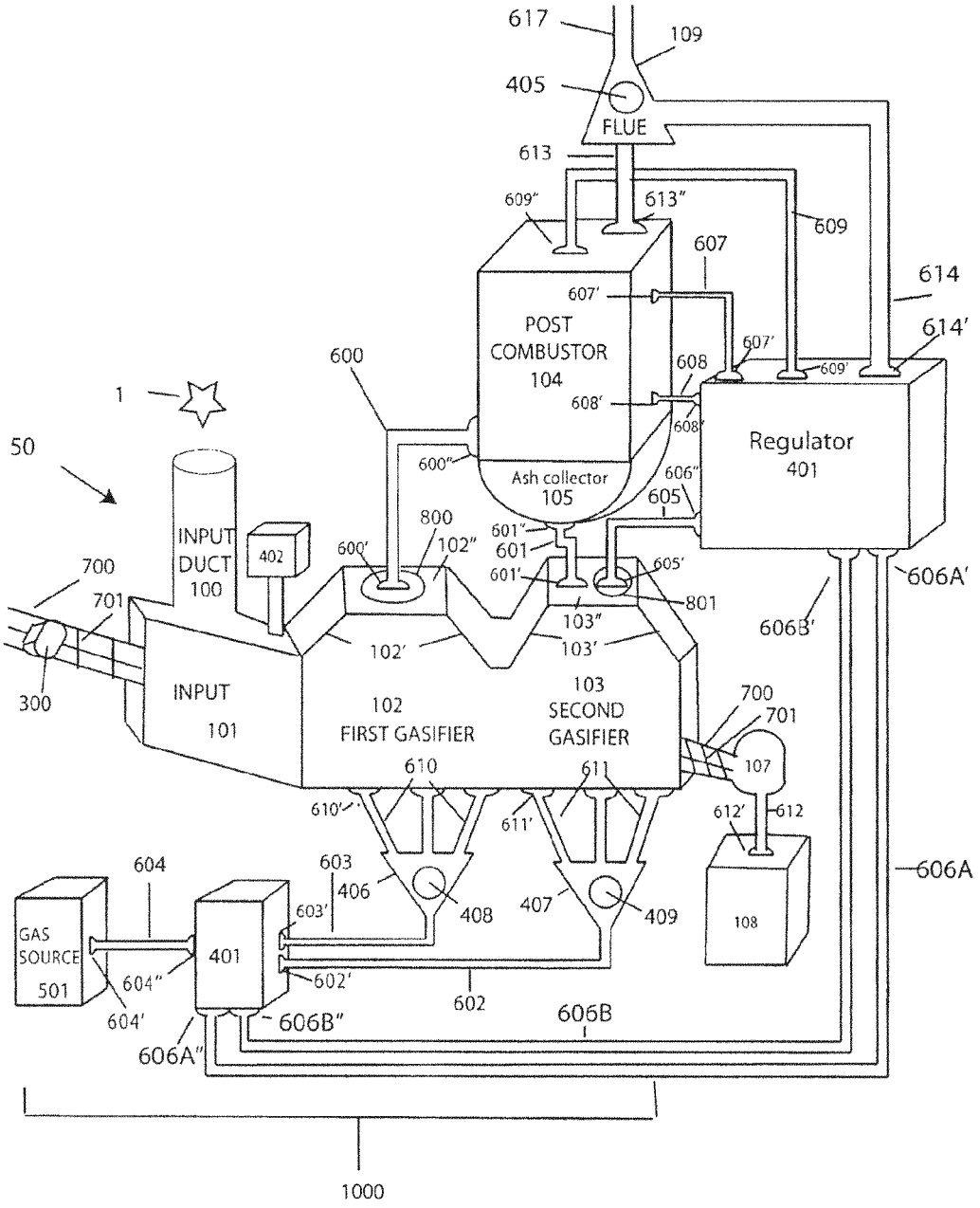
FIG. 4 is a forward view of an embodiment of the present invention having one regulator.

The post combustor 104 may also include a flue 109 that permits gas to leave the post combustor 104 through a flue escape 617. Alternatively, gas may be rerouted through the system 50 through the flue gas return regulator 403, which may send the gas to regulator 400 or gas source 501. Additionally, the flue 109 may have a valve 405 and valve controller which controls the distribution of gas flow between ports 617 and 614. The valve 405 may be controlled by a servo magnetic controller or another mechanical, hydraulic, magnetic, or electric controller which can cause the value to open or close. In some embodiments the valve 405 may be partially opened or closed. The valve may be operable to allow all of the gas exiting the post combustor 104 to escape the system, or to recirculate some of the gas to regulator 403. As shown, port 615 transfers gas to regulator 400, port 606A transfers gas from gas splitter 401 to regulator 403, and port 606B transfers gas from regulator 403 to gas splitter 401. Each port 614, 615, and 606 may have their own connectors 614', 615', 615", 606A', 606B', 606A" and 606B" as well. The regulators 400 and 403 may be able to open and close optional valves in these ports as well. Flue gas regulator 403 may be linked with controller 402 and regulator 400 as well. Gas regulator 403 may comprise a controller to control the position of the flue valve, to regulate how much gas from the flue and the gas source flows through gas port 615. As shown in FIG. 4, one regulator 401 may perform the functions of regulators 403 and 400.

Figure 2:
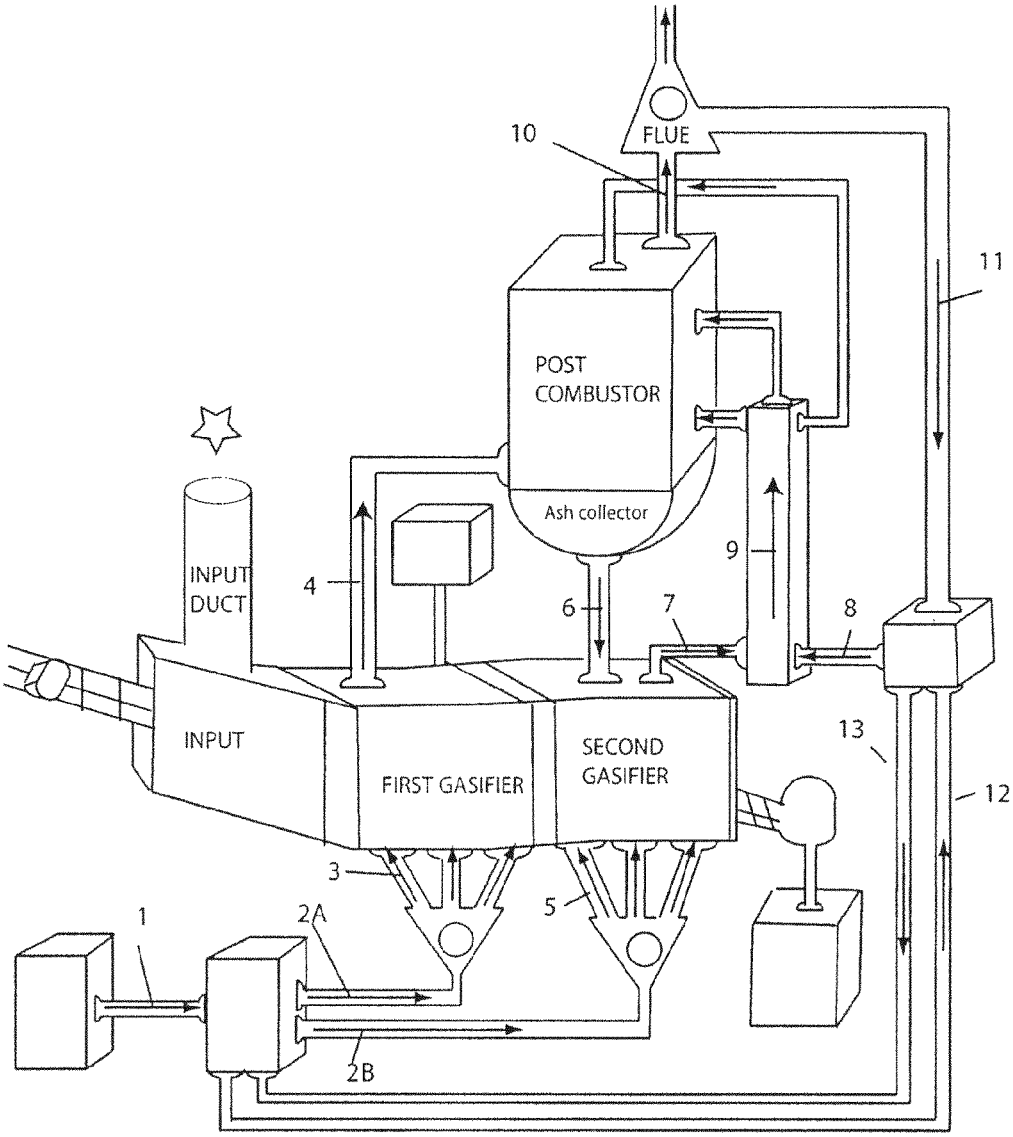
FIG. 2 is a forward view of an embodiment of the present invention illustrating the gas flow through the system.

FIG. 2 illustrates a process flow of the gas through the system 50. Although labeled sequentially, many of the following steps may be performed in a different order or may be performed simultaneously with another step. Step 1, Gas enters the system through gas source 501 where it passes through gas port 604 which is connected by connectors 604' and 604" to gas splitter 401. Step 2, gas splitter 401 can split or portion the gas to gas splitters 406 and 407. As shown in step 13, gas splitter 401 can also receive gas from regulator 403, and can send gas to regulator 403 as shown in step 12. Regulators 403 and 400 or controller 402 may be able to modify how the gas is split between the gas splitters. Step 3, valves 408 and 409 can modify how much gas goes into gas hoppers 610 and 611. Valves 408 and 409 may be controlled by the gas splitters or by any of the regulators or controllers. Step 4, once inside the first gasifier 102, the gas mixes with the gas in the first gasifier. Additionally the gas gasifies the refuse, thereby producing a gas which flows through gasification port 600. Step 5, gases from gas hoppers 611 flow into the second gasifier where they gasify and combust the refuse in the second combustor 103. The resulting gases flow up through the second gasifier port 605. Step 6, ash from ash collector 105 may flow through port 601 into the second gasifier 103. Step 7, gas in the second gasifier gas port 605 may be mixed with new gas from the gas source of regulator 400. Regulator 400 may contain its own gas or have access to gas external to the system 50. Step 8, gas source may also receive recirculated flue gas from port 615. Step 9, gas source may send gas through gas port 606 where it enters regulator 403. Regulator 400 can select how much gas to send to the top or side gas ports 607, 608, and 609. The top 609 and side gas ports 607, 608 send gas to the post combustor 104. Step 10, gas is released up through flue port 613 into the flue 109, and heavier weight particles settle in ash collector 105. The flue may be controlled through a valve 405 which can also be controlled by any of the regulators or controllers. The valve 405 either allows the flue gas to escape through the flue gas escape 617 and/or it may direct flue gas through the flue gas return port 614, step 11. Flue gas return regulator 403 can send gas to either of the regulator 400 or gas source 501 through gas ports 615 (step 8) or 606B (step 13).

Figure 5:
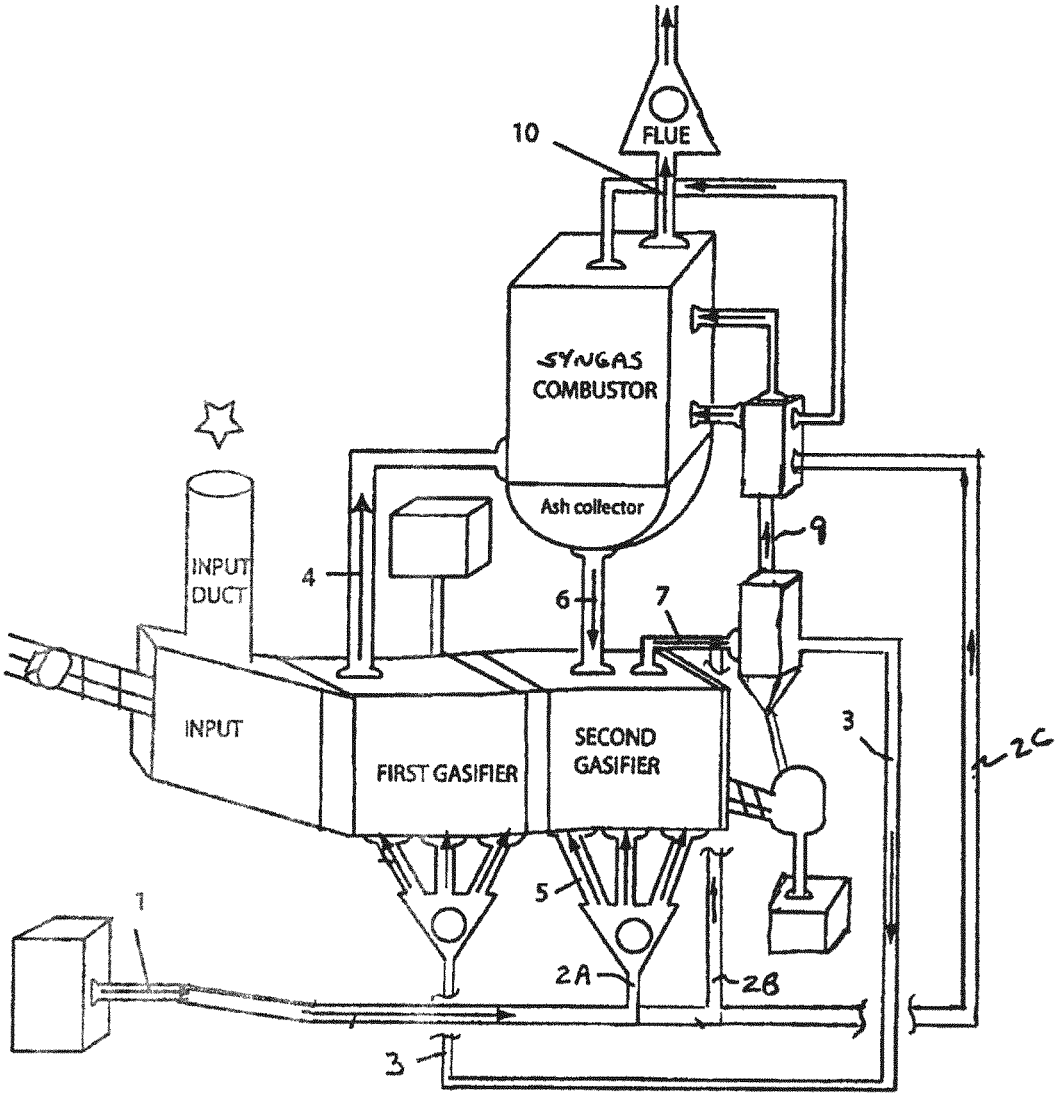
FIG. 5 is a forward view of an embodiment of the present invention illustrating certain aspects of the gas flow through the system.

In an embodiment of the invention, the system may include an advancer and two gasifier chambers wherein the second gasifier may complete the combustion of unreacted carbon in the solid residue passing from the first gasifier to the second gasifier (see FIG. 5). The second gasifier may be fed with fresh primary air (stream 2A) in an amount that is in excess of the amount needed to complete the combustion of the carbon content of the solid material entering the second gasifier chamber. The fresh primary air distribution to the second gasifier chamber is controlled to achieve a high burnout efficiency of the carbon, leaving a low residual carbon content in the ash exiting the second gasifier.

The hot combustion flue gas from the second gasifier chamber (stream 7) may be mixed with additional fresh air (e.g. stream 2B) to control the temperature of the gas, and may be passed through a particulate removal device to remove entrained particulate. The gas exiting the particulate removal device may be used to provide both primary and secondary air to the first gasifier chamber (e.g. stream 3) at a flowrate to control the temperature in the first gasifier chamber at a level necessary to promote the drying and gasification of the incoming waste. This temperature will vary depending on the heating value of the waste feed, but, as an example, may typically range between around 1600° F. and around 1800° F. The elevated temperature of stream 3 caused by the energy release from combusting the residual carbon content in the residue entering the second gasifier chamber increases the rate of drying and gasification of the waste in the first gasifier chamber, thereby reducing the fraction of the organic content in the waste that must be oxidized in the first gasifier chamber and in turn, reducing the required sub-stoichiometric flow of oxygen-containing air to the first gasifier chamber. This energy integration increases the heating value of the syngas produced from the first gasifier chamber (stream 4) as measured by, for example, its hydrogen and carbon monoxide contents. This represents a significant efficiency improvement over the prior art.

The syngas exiting the first gasifier chamber (e.g. stream 4) may be sent to a syngas combustor where it is combusted with the remaining hot gas from the particulate removal device (e.g. stream 9). Some amount of fresh air (stream 2C) may also be included if necessary to complete the combustion of the syngas. The distribution of streams 4 and 2C may be controlled to achieve low levels of both $NO_x$ and CO in the flue gas exiting the syngas combustor (e.g. stream 10).

Gasification reactions in the first chamber may be controlled separately from combustion reactions in the second chamber, and the energy released by the combustion in the second chamber may be efficiently recovered and utilized to promote the gasification reactions in the first chamber. This process integration enables the required air flow to the first gasification chamber to be minimized, which among other advantages, increases the heating value of the syngas produced from the first chamber.

Figure 5A:
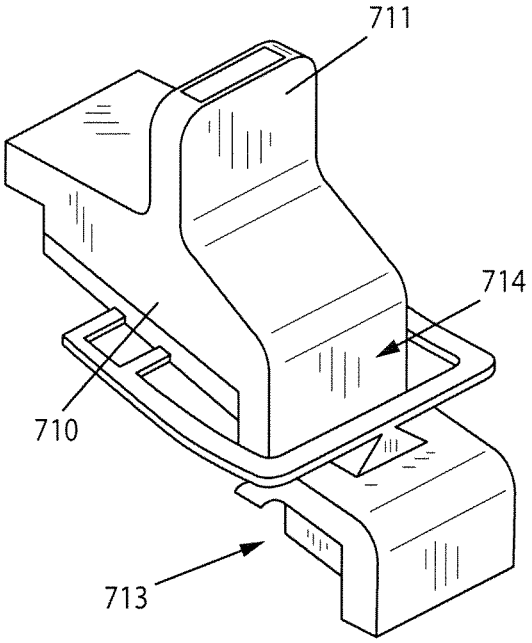
FIG. 5*a* is a schematic of a further embodiment of the present invention.

FIG. 5A is a schematic of another embodiment of the present invention. This embodiment includes one or more gasifiers 710 connected to a post combustor through outlet 711 and a second post combustor 713 through connection 714. The second post combustor 713 and the gasifier may be connected by, for example, a drop chute. In this embodiment, as in the other systems and methods described herein, the flue gas from the post combustor may be recirculated throughout the system. For example, the flue gas may be recirculated from the second post combustor 713 to the one or more gasifiers 710 where it may be used as a primary gas source, either alone or in conjunction with other gas sources. A seal may be maintained between the one or more gasifiers 710 and the second post combustor 713 by allowing residue exiting the one or more gasifiers 710 to pile in the chute between the one or more gasifiers 710 and the second post combustor 713. Further, a sensor, such as a nuclear point level detector, may be used to indicate when the chute is full. This may trigger the system to move the residue into the second post combustor 713, such as by operation of a feed ram. The second post combustor 713 may comprise a burnout chamber wherein residue from the one or more gasifiers is oxidized with excess oxygen. The residue may comprise gas residue, non-gas residue including organic content that was not oxidized in the one or more gasifiers, or a combination of gas and non-gas residue. For example, the amount of oxygen supplied in the second post combustor 713 may be over the stoichiometric requirement for complete combustion of the remaining organic content in the second post combustor. As a further example, the concentration of oxygen may be between about 4 and about 10% $O_2$ as measured in the vapor space above the grate in the second post combustor. In one embodiment, the temperature of the excess oxygen is ambient temperature. The excess oxygen may be supplied as air, such as ambient air. In certain embodiments, the outlet 711 may provide an outlet for gas for combustion. For example, the gas may be syngas, a similar gas, or a mixture of syngas and other gasses. The gas, such as syngas, may be combustor in a first post combustor.

The systems and methods described herein may also include one or more infrared sensors to monitor the temperature. For example, the temperature of the residue exiting the one or more gasifiers may be monitored, or the temperature of the material exiting the one or more post combustors may also be monitored. These temperature signals may be used to control the distribution or of air or fuel into the post combustors and the gasifiers.

Figure 6:
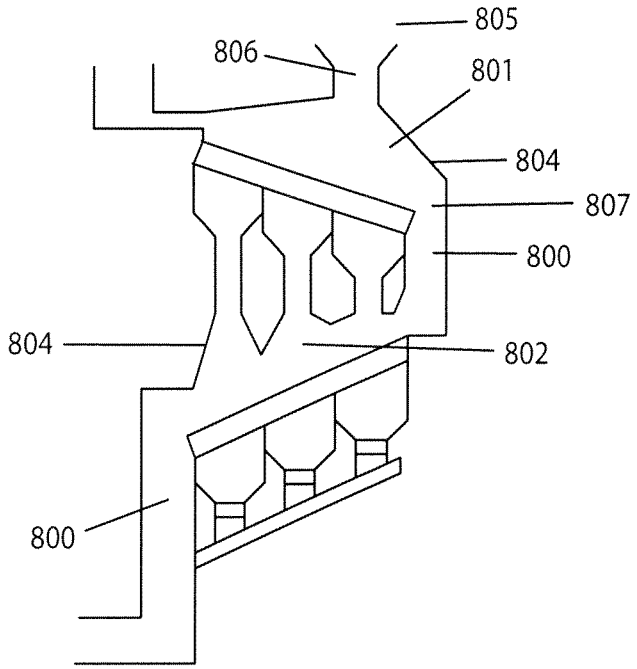
FIG. 6 is a further embodiment of the present invention.

FIG. 6 provides another example of an embodiment of the invention. This embodiment includes a gasifier 801, an outlet 805, and a post combustor 802. In this embodiment, the gasifier 801 is above the post combustor 802 such that hot gases from the post combustor may be directed into the gasifier. In one embodiment, the gasifier 801 is on top of the post combustor 802 such that the hot gasses flow directly into the gasifier 801. The gases from the post combustor may be used as a primary gas source for the gasifier, either alone or in conjunction with other primary gas sources. Residue from the gasifier may flow into the post combustor. A seal 807 may be maintained between the gasifiers 801 and the post combustor 802 by allowing residue exiting the gasifiers to pile in the connection between the gasifiers 801 and the post combustor 802. Further, a sensor 800, such as a nuclear point level detector, may be used to indicate when the connection is full. This may trigger the system to move the residue into the post combustor 802, such as by operation of a feed ram. The post combustor 802 may comprise a burnout chamber wherein residue from the one or more gasifiers is oxidized with excess oxygen.

The outlet 805 may be configured such that certain gases from the gasifier flow out the outlet 805. For example, the gas may comprise syngas, a similar gas, or a mixture of syngas and other gasses. The gas that flows out the outlet 805 may be combusted in a second post combustor. The outlet 805 may include a sensor for analyzing the content of the gas passing through the outlet 805. For example, a tunable diode laser 806 may be used to determine the $O_2$, $CO_2$, and $H_2$ content. The system may include one or more infrared sensors 804 to monitor the temperature. For example the temperature of the residue exiting the gasifier may be monitored and the temperature of the material exiting the post combustor may also be monitored. These temperature signals may be used to control the distribution of air into the post combustor and gasifiers.

It is hereby claimed:

1. A two stage refuse gasification combustion system for processing refuse comprising an advancer, a first and second gasifier, a first gas regulator, a central controller, and a post combustor, wherein:

said advancer comprises a means for moving the refuse from the first gasifier to the second gasifier;

said post combustor comprises a connection to the first and second gasifier;

said first gas regulator comprises an input port for receiving gas, an output port for outputting gas, and valves for regulating gas flow in the system;

said second gasifier completes combustion of unreacted carbon received from the first gasifier and wherein hot combustion gas from the second gasifier is recirculated to the first gasifier; and said central controller contains software for causing the controller to perform the steps of:

controlling the speed of the advancer;

controlling the flow rate of gas through a first and second gas splitter; and controlling the positioning of the valves in the first gas regulator.

2. The system of claim 1 wherein the post combustor comprises an ash collector designed to receive fly ash and heavy weight particles, wherein said ash collector is connected to the second gasifier for directing the fly ash and heavy weight particles into the second gasifier.

3. The system of claim 2 wherein the ash collector has a conical or cyclone shape.

4. The system of claim 1 comprising an input having an opening formed by an outer housing for receiving said refuse.

5. The system of claim 1 further comprising a first gas hopper fluidly connected to the first gas splitter and the first gasifier, wherein said first gas splitter is connectable to a gas source for receiving gas external from the system, and said first gasifier comprises a sloped top for directing gas into the post combustor.

6. The system of claim 5 further comprising:

a flue connected to the post combustor, wherein said flue comprises a valve operable to allow gas to escape the system when the valve is in a first position or cause at least some of the gas to recirculate when the valve is in a second position; and a second gas regulator for directing gas through the system, wherein said second gas regulator comprises:

a connection with the flue to receive recirculated gas from the flue;

a controller to control the position of the valve;

a connection to the gas source to allow the second gas regulator to receive gas external from the system;

a gas output connected to the first gas regulator to direct gas into the first gas regulator; and a valve and valve controller to control how much gas from the flue and the gas source flows through the gas output.

7. The system of claim 5 further comprising a second gas hopper fluidly connected to the second gas splitter and the second gasifier, wherein said second gas splitter is connectable to a gas source for receiving gas external from the system, and said second gasifier comprises a sloped top for directing gas into the post combustor.

8. The system of claim 1 wherein the first gas regulator comprises:

a gas source containing compressed gas or a gas movement device;

a sensor for determining gas temperature or oxygen content of gas in the post combustor or in ports leading into the post combustor; and an adjuster for adjusting the amount of gas flowing into the post combustor, said adjuster also allowing the regulator to adjust the angle in which ports expel gas into the post combustor.

9. The system of claim 1 further comprising a flue connected to the post combustor, wherein said flue comprises a valve operable to allow gas to escape the system when the valve is in a first position or cause at least some of the gas to recirculate when the valve is in a second position.

10. The system of claim 9 further comprising a second gas regulator for directing gas through the system and a valve controller to control the position of the valve, wherein said second gas regulator is connected to the flue to receive recirculated gas from the flue.

11. The system of claim 1 wherein the first gas regulator comprises an input for receiving gas from the second gasifier and an input for receiving gas from a second gas regulator, and at least three output ports for directing gas into the post combustor, wherein the first output port is connected to a lower portion of a sidewall of the post combustor for directing gas horizontally in the post combustor, the second output port is connected to an upper portion the sidewall of the post combustor for directing gas horizontally in the post combustor, and the third output port is connected to a top portion of the post combustor for directing gas downwardly into the post combustor.

12. The system of claim 11 wherein the first gas regulator comprises an adjuster for manipulating the angle at which the three output ports direct gas into the post combustor.

* * * * *